US010468003B2

(12) United States Patent
Andersen

(10) Patent No.: US 10,468,003 B2
(45) Date of Patent: Nov. 5, 2019

(54) AUDIO FOOT PEDAL

(71) Applicant: MUSIC TRIBE GLOBAL BRANDS LTD., Road Town, Tortola (VG)

(72) Inventor: Thomas Sirius Andersen, Solbjerg (DK)

(73) Assignee: MUSIC Tribe Global Brands Ltd., Tortola (VG)

( * ) Notice: Subject to any disclaimer, the term of this patent is extended or adjusted under 35 U.S.C. 154(b) by 67 days.

(21) Appl. No.: 15/797,357

(22) Filed: Oct. 30, 2017

(65) Prior Publication Data

US 2018/0122348 A1 May 3, 2018

(30) Foreign Application Priority Data

Oct. 31, 2016 (DK) ..... 2016 70853

(51) Int. Cl.
*G10H 1/34* (2006.01)
*G10H 1/00* (2006.01)
*G10H 1/055* (2006.01)

(52) U.S. Cl.
CPC ..... *G10H 1/348* (2013.01); *G10H 1/0091* (2013.01); *G10H 1/055* (2013.01); *G10H 2210/155* (2013.01)

(58) Field of Classification Search
CPC ..... G10H 1/348; G10H 1/0091; G10H 1/055; G10H 2210/155
USPC ..... 84/662
See application file for complete search history.

(56) References Cited

U.S. PATENT DOCUMENTS 3,663,735 A * 5/1972 Evans ..... G10H 1/14 84/721
4,649,785 A * 3/1987 Chapman ..... G10H 1/06 84/736
5,166,467 A * 11/1992 Brown ..... G10H 1/348 84/715

(Continued)

FOREIGN PATENT DOCUMENTS

JP 2009258643 A 11/2009
WO 8102941 A1 10/1981

OTHER PUBLICATIONS

Danish Search Report for corresponding application PA 2016 70853; dated Mar. 8, 2017.

(Continued)

*Primary Examiner* — David S Warren
*Assistant Examiner* — Christina M Schreiber
(74) *Attorney, Agent, or Firm* — Seed Intellectual Property Law Group LLP

(57) ABSTRACT

An audio foot pedal having an activation arrangement comprising a control button and a stationary part, the control button being secured to the stationary part for relative movement along a travel range, the activation arrangement providing a control signal in response to movement of said control button, the audio foot pedal further comprising at least one signal processing arrangement arranged to execute at least two different functional modes, wherein at least one of said functional modes, in response to said control signal, variably controls a signal processing of audio signals communicated to said at least one signal processing arrangement thereby producing an audio output signal to an audio output, and wherein said control signal also controls switching between said at least two functional modes.

24 Claims, 4 Drawing Sheets

(56) References Cited

Figure 1:
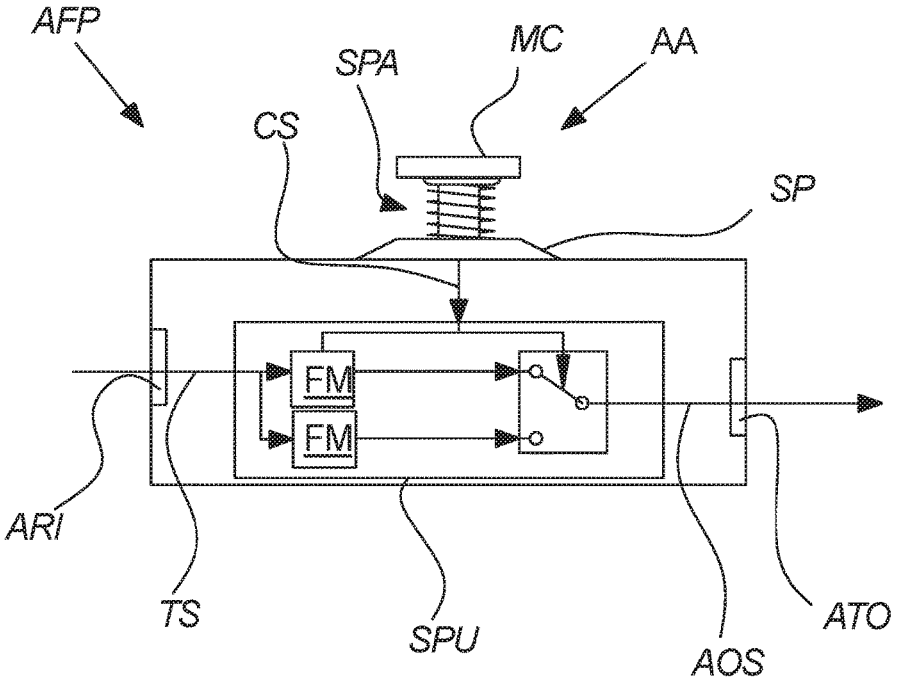

U.S. PATENT DOCUMENTS 5,561,575 A * 10/1996 Eways ..... G10H 1/348 360/137
7,820,904 B1 * 10/2010 Robling ..... G10H 3/186 84/600
7,923,623 B1 * 4/2011 Beaty ..... G10H 1/0091 84/701
8,785,761 B2 * 7/2014 Tabata ..... G10H 1/46 84/741
9,035,165 B2 * 5/2015 Cho ..... G10H 1/0008 84/746
9,047,850 B1 * 6/2015 Beaty ..... G10H 1/0091
9,495,947 B2 * 11/2016 Packouz ..... G10H 1/40
9,589,549 B1 * 3/2017 McKay, II ..... G10H 1/348
9,892,719 B2 * 2/2018 Wilk ..... G10H 1/055
9,905,210 B2 * 2/2018 Packouz ..... G10H 1/42
2004/0099129 A1 * 5/2004 Ludwig ..... G10H 1/00 84/663
2007/0256549 A1 * 11/2007 Yamada ..... G10H 1/0091 84/662
2009/0235803 A1 * 9/2009 Iwamoto ..... G10H 1/346 84/229
2011/0271820 A1 * 11/2011 Cockerell ..... G10H 1/348 84/746
2013/0239789 A1 * 9/2013 Tabata ..... G10H 1/46 84/741
2014/0331850 A1 * 11/2014 Cho ..... G10H 1/0008 84/633
2015/0371622 A1 * 12/2015 Beaty ..... G10H 1/46 84/633
2016/0314772 A1 * 10/2016 Alstad ..... G10H 1/348
2018/0122348 A1 * 5/2018 Andersen ..... G10H 1/055
2018/0144731 A1 * 5/2018 McHale ..... G10H 1/348

OTHER PUBLICATIONS

Ibanez WD7 Weeping Demon Wah Pedal, Product Manuel, Retrieved online, URL: https://web.archive.org/web/20120511214328/http://resources.ibanez.com, 2012, retrieved on Mar. 3, 2017.
European Search Report for corresponding application EP 17 19 9327; dated Nov. 21, 2017.

* cited by examiner

AUDIO FOOT PEDAL

CROSS-REFERENCE TO RELATED APPLICATIONS

This application is related to and claims the benefit of Danish Patent Application No. DK201670853 filed on Oct. 31, 2016, the entire contents of which are herein incorporated by reference.

FIELD OF THE INVENTION

The present invention relates to foot operated audio pedals, more particularly guitar pedals for use with electric guitars, bass guitars, etc.

BACKGROUND OF THE INVENTION

Foot pedals for control of musical instruments is an old but very specialized discipline. Such pedals include foot pedals for controlling distortion, chorus, sound coloring, etc. The relevant instrument may e.g. be a string instrument such as a bass or a guitar where a musician at the same time is able to use the controllers on e.g. the guitar and the foot controlled function. Even sometimes while playing.

A challenge in relation to control of musical instruments is that such controllers may be applied for this thereby resulting in very complex control setups, e.g. including pedals boards with multiple controllers. Many pedal boards include more than 8 foot controllers. This is expensive, but more importantly, the control setup is often very inconvenient for the musician.

The present invention may address some of these challenge of the prior art.

SUMMARY OF THE INVENTION

In one aspect, the invention relates to an audio foot pedal comprising an activation arrangement comprising a control button and a stationary part, the control button being secured to the stationary part for relative movement along a travel range, the activation arrangement providing a control signal in response to movement of said control button, the audio foot pedal further comprising at least one signal processing arrangement arranged to execute at least two different functional modes, wherein at least one of said functional modes, in response to said control signal, variably controls a signal processing of audio signals communicated to said at least one signal processing arrangement thereby producing an audio output signal and transmits the audio output signal to an audio output, and wherein said control signal also controls switching between said at least two functional modes.

According to an embodiment of the invention, a dual function foot switch is provided, allowing a user to use the control button with his foot to control switching between functional modes, e.g. different types of sound effect e.g. modulation, chorus, modulation depth, bypass, modulation speed, etc., and with the same button control a variable control parameter of at least one of the functional modes, e.g. selected types of modulation. The control button may for example be provided as a single integrated structure without multiple switches or modulators, thereby rendering the control button applicable for several different types of purposes of foot control.

According to the present invention, it is possible to provide a foot pedal with a single control button that can be used to switch between different functional modes, for example in response to the button moving in a switching range of the travel range, while also controlling at least one of the functional modes in a signal processing arrangement, by providing a control signal from the activation arrangement in relation to the travel length of a control button of the activation arrangement, for example in response to the button moving in a modulation range of the travel range. The control button may therefore function as a multi-purpose control button, for example having a travel range comprising a switching range and a modulation range, partially overlapping or non-overlapping.

According to embodiments of the invention, using an activation arrangement for several tasks is advantageous as it is easier for a musician to control the foot pedal while playing the instrument at the same time. Further, the user only needs a single activation arrangement in order to control several functions instead of having several buttons, pedals, switches etc., to choose from. This is beneficial as a typical user often has to choose between several buttons while playing which can be confusing. Further, the buttons have often similar shape and size, which makes it easy to get mixed up.

Providing the signal processing arrangement with a control signal that provides information about the control button position along its travel range is advantageous, as this provides the signal processing arrangement with more detailed information in contrast to a conventional switch which outputs on/off-signal. This information can be used to decide what shall happen when the button is e.g. half way down, in the beginning of a movement, at the end of the button range etc., A feature of the present invention is that the control signal is used as input for switching between different functional modes as well as a means for providing input variables to signal processing algorithm related to a selected mode. The signal processing algorithm may be executed in the signal processing arrangement. This is beneficial as it is often preferred by the user to be able to control variable parameters of a currently selected signal processing algorithm in order to generate a unique audio effect by controlling the foot pedal. Further, controlling the variable parameters related to one or more of the functional modes by the control signal is advantageous in that it allows for modulation of the audio signal according to the movement of the user's foot. This enables the user to adjust parameters in the signal processing algorithm in real time while playing instead of having to adjust variable parameters by hand which results in the user having to stop playing the instrument.

In this context, a functional mode is understood as a state wherein a signal processing algorithm having adjustable input parameters is executed in a related signal processing arrangement and where the resulting audio is transmitted to an audio output. These algorithms serve the purpose of modifying an audio signal by adding audio effects to the signal. Any kind of audio effects is within the scope of the present invention, and may, e.g., comprise different kinds of modulation or sound effects such as, e.g., distortion, wah-wah, chorus or reverb, alteration of audio attributes such as, e.g., volume, bass- or treble-contents, etc.

The control button may be understood as a range sensor, stepping switch, linear switch, uniselector, etc., i.e. any mechanism for translating a movement of an object to a control value for controlling some aspects of a machine or process. The switch may output values depending on its position in a range.

In this context travel range should be understood as the range of motion that the multipurpose control button can travel e.g. the range spanning from fully collapsed position to fully extended position.

The control signal may be any digital or analogue, optical etc., representation of values that enable determination of the multipurpose control button's position along its travel range.

An advantageous embodiment is obtained when only a part of the travel range, preferably less than half the travel range, is applied for establishment of control signals for variably controlling signal processing, i.e. when only movement within a part of the travel range is used to adjust parameters of functional modes, and another part of the travel range, partially overlapping or non-overlapping, is used to control switching between functional modes.

Audio signals may for example be any digital or analogue signal established by a transducer e.g. an electric guitar, keyboard, microphone etc., e.g. signals transmitted by musical instruments.

A further advantage of embodiments of the invention is that the activation arrangement may be established by means of a shared sensor. Typically, foot pedals will require a logical distinguishing between switching and modulation and thereby requiring multiple sensor elements. The present invention may advantageously be applied with the use of one shared sensor, e.g. a Hall effect sensor, sensing the position of the control button along the travel range explicitly or implicitly for the establishment of a control signal controlling both switching between functional modes and adjustment of variable parameters of the selected functional mode.

In an advantageous embodiment the activation arrangement, e.g. the control button, is communicatively coupled to said signal processing arrangement.

An advantageous embodiment is obtained when the control signal forms variable input parameters to a signal processing algorithm related to the at least one of said functional modes when the control signal has invoked a switching to said at least one of said functional modes. Preferably, this is applied in response to said control button moving in said modulation range.

The functional mode may comprise a function, e.g. an audio effect, that may be controlled by variable parameters that can affect the output of the signal processing arrangement. Enabling the user to control the variable parameters using the control signal is advantageous as the control signal may provide a range of values in contrast to an on/off switch where spatial resolution is lower. A further advantage is that the control signal is already being used for switching between functional modes. Hence, the user does not have to remove his foot after activating the desired functional mode to provide values to the variable parameters of the functional mode, which makes it easier to control the audio foot pedal.

An advantageous embodiment is obtained when the control signal is provided by a sensor in response to a position along the travel range of the control button relative to the stationary part.

The sensor may be any distance senor of, for example, optical, ultrasonic or magnetic type, capable of measuring the position of the button relative to the stationary part along the travel range.

An advantageous embodiment is obtained when the sensor is a Hall effect sensor.

According to embodiments of the invention, using a Hall effect sensor in order to determine the position of the control button is advantageous as the distance sensing is determined by the changes in magnetic fields and the sensing will therefore not break due to long term use of the audio foot pedal.

An advantageous embodiment is obtained when the travel range comprises a modulation range and a switching range.

The modulation range and the switching range are each understood as a range of positions of the control button along the travel range, i.e. also relating to ranges of distances of the control button from a resting position or default position. In other words, a range of positions may preferably be related to switching control, and another range of positions may preferably be related to modulation control.

By grouping a set of values in ranges, an advantageous embodiment is obtained, which facilitates that values in a group can be used for determining the correct action to a movement of the button with a greater success than with a threshold value. When the multipurpose control button is operated in the switching range, it may in an embodiment be determined if a switching is requested by monitoring the traveling of the multipurpose button to see if it travels along the entire switching range, or a predetermined significant amount of the switching range. This may be advantageous over having a threshold value where flicker, chattering, and other signal noise can be misinterpreted as a switching request.

Providing the switching range and modulation range may improve certainty to what action is requested by the user when moving the control button. Further, it enables that the multipurpose control button can operate in a range of values for modulation without invoking a switching function in the process, and/or vice versa.

An advantageous embodiment is obtained when the modulation range and the switching range are non-overlapping.

By providing non-overlapping ranges for modulation and switching, respectively, is provided a high degree of certainty of operation, as any position along the travel range belongs to a single, well-defined range and thereby functionality. However, the signal processing unit may preferably be provided with control rules to determine the interpretation of control button movements starting in one range but finishing or visiting another range. Examples of such control rules are described further herein.

An advantageous embodiment is obtained when the modulation range and the switching range are partially overlapping.

By having partially overlapping ranges is provided a longer part of the travel range for modulation and/or switching, thereby possibly providing better modulation resolution and/or higher switching reliability. The signal processing unit may be arranged with algorithms to determine when a position in the overlapping range should be interpreted as modulation input, switching input or both. This may for example be determined from a position in a non-overlapping part of the range, where the movement is initiated or paused for a predetermined amount of time.

Further, by having the modulation range and the switching range either partially overlapping or non-overlapping, results in at least two regions of the travel range being dedicated for specific purposes, which may be advantageous when controlling multiple functions with a single activation arrangement.

An advantageous embodiment is obtained when the variable parameters of a signal processing algorithm are provided when said multipurpose control button is in said modulation range.

An advantageous embodiment is obtained when the travel range comprising the switching range and the modulation range, with the modulation range closer to the stationary part.

An advantageous embodiment is obtained when the control button has a resting position at an extended position at one end of the travel range defining an end of the switching range, and a depressed position at the other end of the travel range defining an end of the modulation range.

An advantageous embodiment is obtained when the modulation range is shorter than the switching range.

An advantageous embodiment is obtained when the modulation range is less than half, such as less than 25% or 20%, of the full travel range, and the switching range is more than half, such as more than 75% or 80%, of the full travel range.

An advantageous embodiment is obtained when the modulation range is 3 millimeters or less, such as 2 millimeters or less, e.g. 1 millimeter or less.

An advantageous embodiment is obtained when the audio foot pedal is arranged to operate in the modulation range and variably control said at least one of said functional modes without invoking a switching of functional mode in the process.

An advantageous embodiment is obtained when the variable parameters of the at least one of the functional modes variably controlling a signal processing, are formed by the control signal when the control button is within the modulation range and when the control signal has invoked a switching to the at least one of the functional modes.

In other words, a preferred embodiment provides modulation of the signal processing of a certain functional mode when the user has selected this functional mode by applying the switching functionality, and then afterwards moves the control button within the modulation range.

In an embodiment of the invention the at least two functional modes comprise a by-pass mode. The pedal may, when switched to the by-pass mode, transmit audio signals fed to the audio input of the pedal to the audio output of the pedal without adding an effect to the audio signal. The by-pass mode may refer to a true by pass mode or a semi-true bypass where the only modification of the audio signal is invoked through the applied transmission path between the audio input and the audio output of the pedal.

An advantageous embodiment is obtained when the switching to said at least one of said functional modes is controlled on basis of said control signal and a predetermined time threshold related to said control signal.

In a preferred embodiment the switching between functional modes is determined by the value of the control signal and a time duration. This is advantageous by improving mitigation of false signals caused by flicker, chattering, blunt spring, noise etc., or for example unwanted signals that come as a result of long term or rough use of the button. Further, the time threshold is preferably applied to determine a foot operated click movement used to indicate a request to switch between the functional modes, e.g. switch between bypass and audio effect, and characterized by the user removing the foot within a relatively short time threshold, as compared to a foot operated click-and-hold movement used to variable control processing parameters, and characterized by the user keeping his foot at the control button and applying varying force to the button to control the variable parameters.

An advantageous embodiment is obtained when said controlling of switching between said at least two functional modes (FM) on the basis of said control signal (CS) and said predetermined time threshold (TT) is arranged to toggle said functional modes (FM) when a duration of said control signal (CS) is shorter than said predetermined time threshold (TT).

An advantageous embodiment is obtained when said controlling of switching between said at least two functional modes (FM) on the basis of said control signal (CS) and said predetermined time threshold (TT) is arranged to switch to said at least one functional mode (FM) variably controlling said signal processing and perform said step of forming variable input parameters (VP) to said signal processing algorithm of said at least one of said functional modes (FM), when a duration of said control signal (CS) is longer than said predetermined time threshold (TT).

An advantageous embodiment is obtained when the control button is foot-operated. This may be advantageous as the user can play an instrument e.g. guitar, using both his hands, while at the same time change or modify functions to achieve a desired audio effect while playing.

An advantageous embodiment is obtained when the audio foot pedal comprises an audio receiving input capable of receiving said audio signals from a musical instrument and adapted for transmitting said audio signals to said signal processing arrangement.

The audio receiving input may e.g. comprise a female jack typically used for musical instruments such electrical guitars, bass guitars, etc.

An advantageous embodiment is obtained when the audio output is adapted for transmitting modified audio signals to an output such as a speaker. The audio transmitting output may e.g. comprise a female jack typically used for musical instruments such electrical guitars, bass guitars, etc.

An advantageous embodiment is obtained when the audio foot pedal comprises a visual indicator displaying an indication of a functional mode selected by said control button.

The visual indicator may in an advantageous embodiment simply display whether the pedal is in bypass-mode or not. In an embodiment, the visual indicator may give the musician clear knowledge about which functional mode the audio foot pedal is switched to. Further, the visual indication may also display any changes to one of the functional modes caused by the control signal, e.g. variable parameter values controlled by the control button in the modulation range.

An advantageous embodiment is obtained when the control button is movable along said travel range under influence of a spring force arrangement.

An advantageous embodiment is obtained when the spring force arrangement establishes a spring force keeping the control button at a resting position when the control button is non-activated.

Having a control button that is under influence of a force back arrangement such as a spring that will push the button back to a non-activated state is advantageous, as it allows the user to control the button by only applying force from one direction, e.g. pressing down on the button with his foot and not having to manually pull it back up when movement in the opposite direction is desired, e.g. when finished using it.

Further, having the multipurpose control button to return to a non-activated position ensures that it does not send any undesired control signal to the signal processing arrangement due to the button being stuck in a range, e.g. modulation range, where it processes the audio signal in an undesired manner.

Another advantage of the spring force is that the user can use the spring force to achieve a desired effect when relaxing the force applied to the button with his foot, hence moving back on the travel range to the non-activating position, e.g. a sweeping effect of a variable parameter.

In this context, non-activated should be understood as a position on the travel range where the button is outside any control ranges, e.g. switching range and modulation range, and where the control button is in its extended position e.g. when the button is not pressed by a foot or the like.

An advantageous embodiment is obtained when the spring force arrangement establishes a first spring force within a first travel range of said control button, and a second spring force in a second travel range of said control button. The first spring force and second spring force are preferably different. The first and second travels ranges are preferably non-overlapping or at least partly non-overlapping, i.e. establishing a part of the travel range having one spring force, a part of the travel range having a different spring force, and possibly an intermediate part of the travel range having a combined or transitional spring force. The second spring force may be a combination of the first spring force and an additional (positive or negative) spring force.

An advantageous embodiment is obtained when the first spring force is active when the control button is in said switching range and at least said second spring force is active when the control button is in said modulation range.

This is advantageous as the two spring forces, preferably of different size, may create the feeling of operating two different functions with the same button, by giving the user tactile feedback to recognize when moving the button between the switching range and the modulation range.

An advantageous embodiment is obtained when the second spring force is greater than said first spring force.

If the second spring force is used in the modulation range, it may be advantageous that the second spring force is larger, for example in an embodiment where a switching functionality relating to the first spring force, has to be activated before the user can modulate parameters of the selected functional mode.

Further, following the travel of the multipurpose control button from its non-activated position and down to fully compressed state, the control button may in a preferred embodiment first encounter the switching range with a force smaller than the following modulation range, which may also preferably have a shorter range.

Further, if a range, e.g. the modulation range, is short, e.g. 3 millimeters, such as 2, such as 1 millimeter or less, it would be advantageous to have a high resistance force such as for example 20-160 Newton, such as 30-100 Newton. Hence the user can perform a more precise modulation of the control signal.

In one aspect, the invention relates to a method for controlling a signal processing arrangement of an audio foot pedal, said method comprising the steps of establishing a control signal in response to movement along a travel range of a control button of an activation arrangement of the audio foot pedal, receiving an audio signal and providing it to the signal processing arrangement, selecting a functional mode of said signal processing arrangement among at least two selectable functional modes, the selecting being based on said control signal, and processing said audio signal by said signal processing arrangement in accordance with said selected functional mode and under variable control by said control signal, thereby establishing an audio output signal.

According to the present invention, it may be possible to provide a foot pedal with a single activation arrangement that can be used to select, as well as control, two different functional modes in a signal processing arrangement, by providing a control signal from the activation arrangement, by utilizing information about the travel length of a multipurpose control button on the activation arrangement.

According to embodiments of the invention, using an activation arrangement for several tasks is advantageous as it is easier for the user to control the foot pedal while playing the instrument at the same time. Further, the user only needs a single activation arrangement to control several functions instead of having several buttons, pedals, switches etc., to choose from. This is beneficial as a typical user often has to choose between several buttons while playing, which can be confusing. Further, the buttons have often similar shape and size, which makes it easy to get mixed up.

Providing the signal processing arrangement with a control signal that provides information about the button's position along its travel range is advantageous as this provides the signal processing arrangement with more detailed information in contrast to a conventional switch which outputs an on/off-signal. This information can be used to decide what shall happen when the button is e.g. half way down, in the beginning of a movement, at the end of the button's range etc.

A feature of the present invention is that the control signal is used as input in a switching mechanism as well as a mean for controlling a function in the signal processing arrangement. This is beneficial as it is often preferred by the user to be able to control variable parameters of an active function to generate a desired audio effect. Further, controlling the variable parameters of the functional mode with the control signal is advantageous in that it allows for modulation of the audio signal according to the movement of the foot. Doing so enables the user to adjust parameters in the functional mode in real time while playing instead of having to adjust variable parameters by hand which results in the user having to stop playing the instrument.

An advantageous embodiment of the method is obtained where a foot operated click movement executed within a time threshold and with a force driving said multipurpose button at least into a switching range of said travel range before it is released, controls said selecting a functional mode of the signal processing arrangement among said at least two functional modes.

In this context a foot operated click movement, or toggle movement or switch movement, should be understood as a motion where the control button is pushed down and released within a relatively short time threshold, in other words a foot applies a constant pressure to e.g. the push surface of the control button until the button is substantially at its compressed state, after which the foot is removed from the button, to allow it to return to its resting position.

An advantageous embodiment of the method is obtained where a foot operated click-and-hold movement followed by an increase in force driving said multipurpose control button at least into a modulation range of said travel range which inputs control signal to said signal processing arrangement which activates said second functional mode and controls variable parameters in said second functional mode based on the amount of force applied to said multipurpose control button.

In this context, a foot operated click-and-hold movement should be understood as a motion where the control button is pushed down and held for a while, in other words a foot applies a constant pressure to e.g. the push surface of the control button until the button is substantially at its compressed state, after which the foot holds the button in the compressed state for a period of time, e.g. 500 milliseconds, 1 second, 2 seconds, etc., whichever is best suitable for the purpose.

An advantageous embodiment of the method is obtained where the time threshold range is less than 2 seconds, less than 1 second, less than 750 milliseconds, or less than 550 milliseconds.

An advantageous embodiment of the method is obtained where the foot operated movement is executed with a pressure force less than 200 Newton, such as less than 150 Newton, or such as less than 100 Newton.

An advantageous embodiment of the method is obtained where the foot operated movement is executed with a pressure force more than 10 Newton, such as more than 50 Newton, or such as more than 100 Newton.

The audio foot pedal in the above method may advantageously comprise an audio foot pedal of any of the above described embodiments of an audio foot pedal.

THE DRAWINGS

Figure 2:
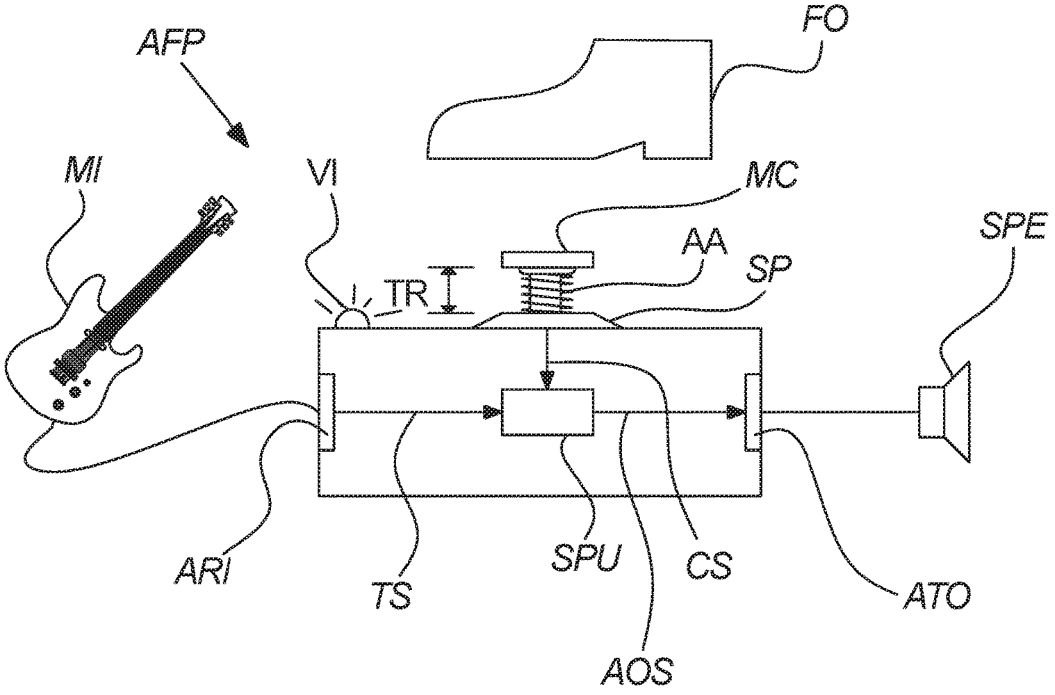
Figure 3A:
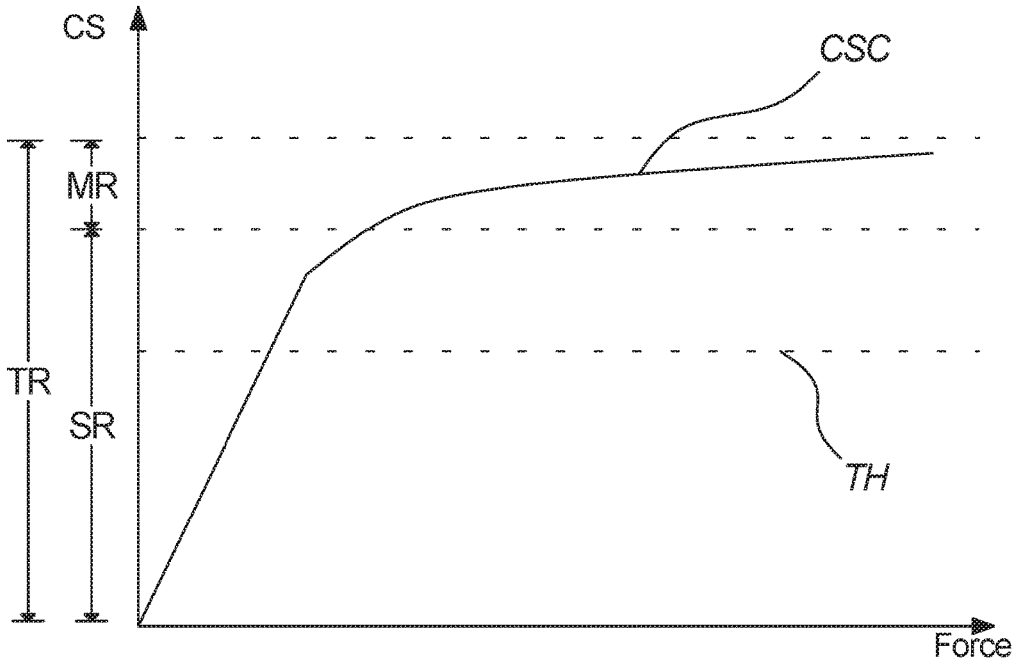
Figure 3B:
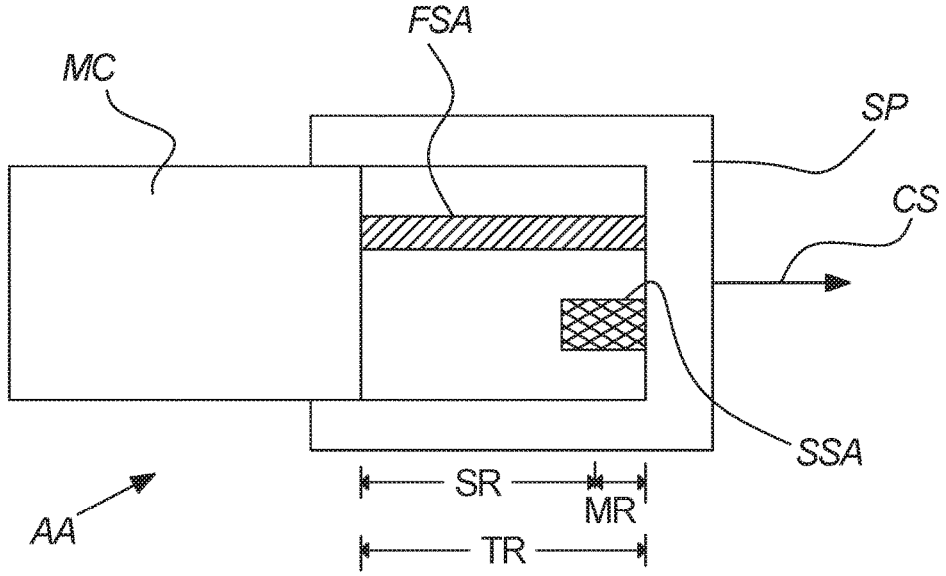
Figure 4:
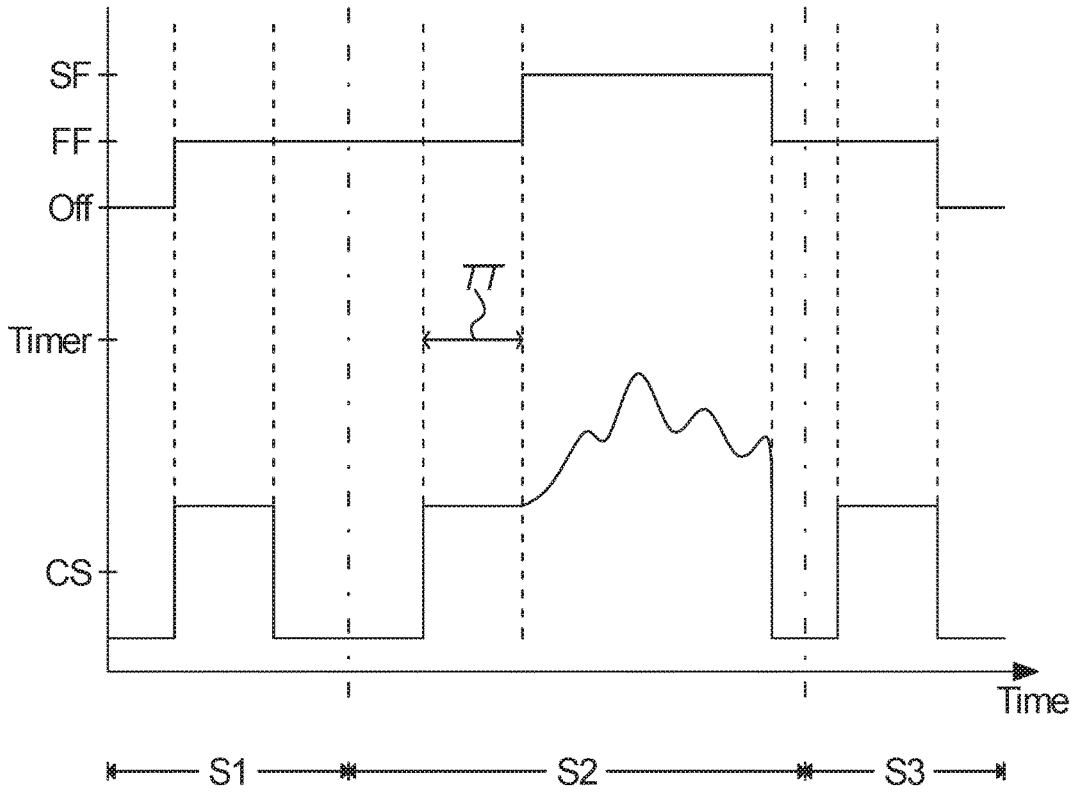
Figure 5:
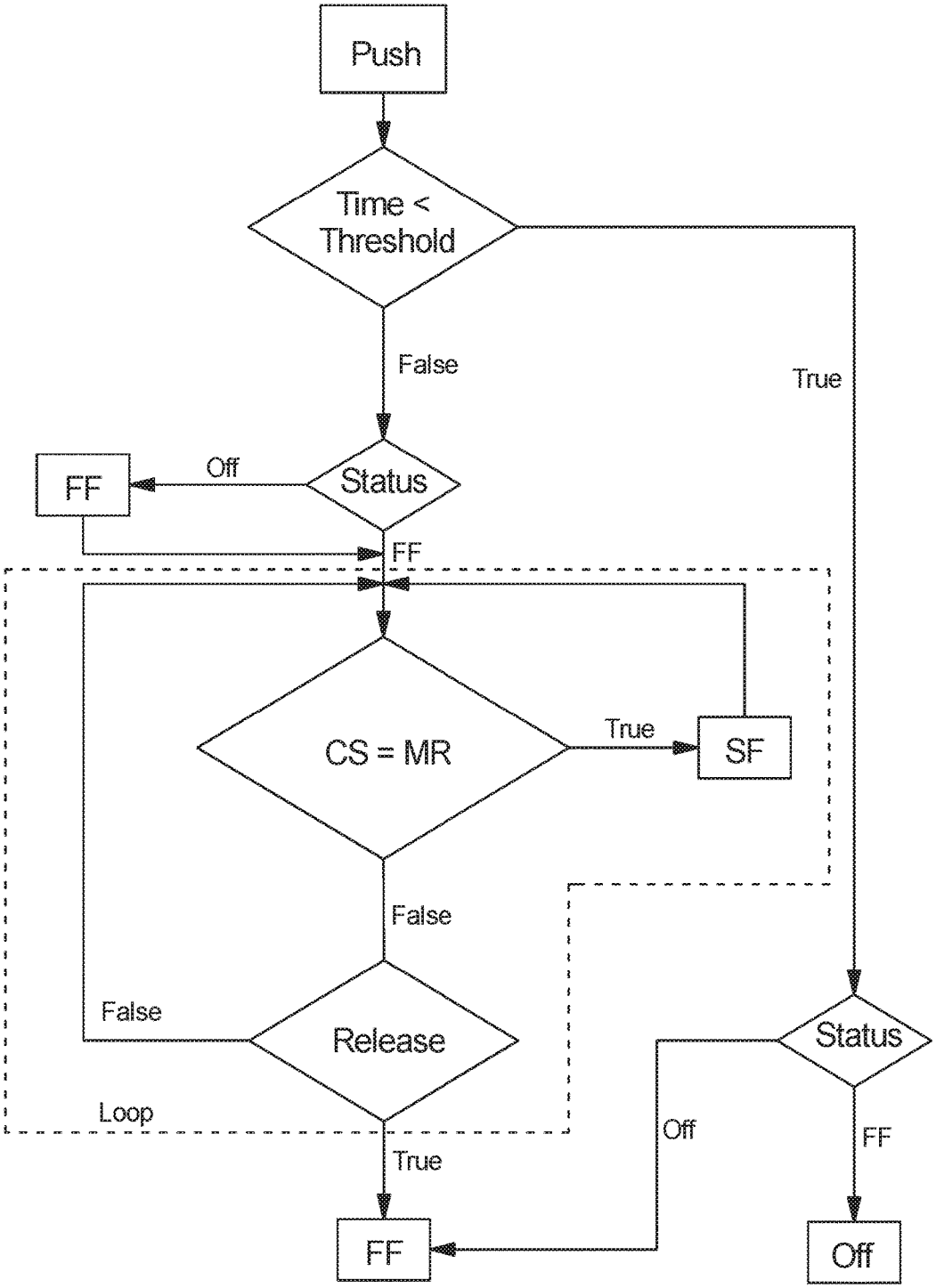

Various embodiments of the invention will in the following be described with reference to the drawings where FIG. 1 illustrates an audio foot pedal according to a preferred embodiment of the invention, FIG. 2 illustrates an audio foot pedal in a simple setup, FIG. 3*a* illustrates a graph displaying an embodiment of the control signal in relation to the travel range, FIG. 3*b* illustrates an activation arrangement relating to the graph of FIG. 3*b*, FIG. 4 illustrates a timing diagram of an embodiment of the invention, and FIG. 5 illustrates flowchart of an embodiment of the invention.

DETAILED DESCRIPTION

FIG. 1 illustrates an audio foot pedal AFP according to a preferred embodiment of the invention.

The illustrated embodiment comprises an audio receiving input ARI, an audio output ATO and a signal processing arrangement SPU comprising two functional modes FM and a switching arrangement. Further the illustrated embodiment comprises and an activation arrangement AA comprising a control button MC and a stationary part SP.

In this embodiment, the signal processing arrangement SPU modifies an audio signal TS from the audio receiving input ARI using one of the two illustrated functional modes FM to an audio output signal AOS which is then transmitted from the signal processing arrangement SPU to an audio output ATO. A control signal CS from the activation arrangement AA is transmitted to the signal processing arrangement SPU an is used to switch between which of the two functional modes FM is transmitted to the audio output ATO. Further in this embodiment the control signal CS is also used as input to one of the functional modes FM, enabling the control signal CS to change variable parameters of signal processing algorithm in that functional mode FM.

In this embodiment, the audio signal TS is to be understood in a broad sense that may be any acoustic signal converted to an electrical signal through a transducer, e.g., stringed instruments having a microphone or a pickup, a key-type instrument e.g., keyboard, MIDI-controller, a vocal microphone etc. This audio signal TS can be a digital or analogue signal. In a further embodiment, this audio signal TS may go through a series of audio modifying systems e.g. foot pedals, tuners, dedicated effect pedals etc. which means that the true audio signal from the musical instruments may be pre-processed before it becomes the audio signal TS inputted to the signal processing arrangement SPU.

The signal processing arrangement SPU modifies the input audio signal TS according to the control signal CS and transmits the modified audio signal to an output channel, here audio output ATO. In this embodiment, the audio foot pedal comprises a single signal processing arrangement SPU. However, in another embodiment the system may comprise several depending on the modification requirements of the audio foot pedal. Further, the signal processing arrangement SPU comprises a single audio input, however, in another embodiment the system can comprise two or more signal inputs, in any combination e.g. an audio signal and a MIDI-signal or two audio signals, etc.

The signal processing arrangement SPU comprises functional modes FM comprising signal processing algorithms such as, for example, reverb, distortion, wah-wah, delay, pitch modulation, etc., which can be used to modify the audio signal TS. Further, the signal processing arrangement enables the adjustment of variable parameters of the algorithms, such that the user can, e.g., adjust the time of a delay algorithm.

One or more of the functional modes FM may comprise two signal processing algorithms, a first signal processing algorithm FF and a second signal processing algorithm SF, which the user can switch between using the activation arrangement AA, which is described in more detail in FIG. 4. However, in another embodiment the signal processing arrangement SPU may comprise three or more signal processing algorithms, which the user also can engage and disengage using the activation arrangement AA.

In this embodiment, a variable parameter of the signal processing algorithm can be controlled by the control signal CS from the activation arrangement AA. The travel range TR of the multipurpose control button MC is associated with a consecutive set of values ranging from e.g. 0-1000, where each value represents a traveled distance of the multipurpose control button along this travel range. In other words, a control signal value tells the current position of the button along the travel range. In this embodiment, the multipurpose control button comprises a magnet providing a magnetic field which is detected by a magnetic field sensor e.g. a Hall effect sensor. The position of the multipurpose control button MC is determined based on the magnetic field strength detected by the Hall effect sensor which output a corresponding value for the control signal CS. However, in another embodiment the position of the multipurpose control button MC can be obtained using optical, ultrasonic, electric or other position sensor techniques.

In an embodiment of the invention, the activation arrangement further comprises a spring arrangement SPA. This arrangement provides a spring tension between the multipurpose control button MC and the stationary part SP. This spring arrangement SPA forces the button to be fully extended from the stationary part positioning the button which can be described as a non-activated state where the button is not depressed by the user's foot and no control signal CS, or e.g. the value 0, is transmitted to the signal processing arrangement SPU.

As force is applied to the button MC by the user, the movable button part will be pressed closer towards the stationary part SP of the activation arrangement AA, which further compresses the spring arrangement SPA. As the user applied pressure is removed, the spring arrangement will move the multipurpose control button MC back to its non-activated position.

As the applied force causes the button to move, the position sensor will detect the movement of the button and convert that into a control signal which is passed on to the signal processing arrangement.

In this embodiment, the spring arrangement SPA comprise a spring, however, in another embodiment, this arrangement could also comprise an elastic ring, pneumatics or the like. Further, in an advantageous embodiment, the spring arrangement comprises at least two different springs having different spring forces, e.g. a spring and an elastic ring, e.g. a rubber or silicone O-ring. An arrangement like such can provide the travel range TR with two types of tensions, creating a nonlinear spring characteristic e.g. progressive or progressive with knee characteristic e.g. the first part of the button's traveling is effected by the spring force of the spring, while the last part of the button's travel is further effected by the spring force of the elastic ring. This effect of the springs characteristic provides a "soft click" function and a "hard click" function where the switching between the two functions are determined by the amount of force applied.

Further the control signal provided, can also be used to gradually change values of variable parameters of a signal processing algorithm, as the user increases the force applied to the button.

FIG. 2 illustrates an audio foot pedal in a simple setup, comprising musical instrument MI, the foot of a user FO, a speaker SPE and an audio foot pedal AFP. In this embodiment, the audio foot pedal AFP comprises an audio input arrangement ARI and an audio output ATO. These arrangements are mechanical plugs adapted for receiving an end of an audio cable such as e.g. jack-cable, XLR-cable, optical cable or similar cables used for transmitting audio signals.

In this embodiment, the audio foot pedal comprises a display or other visual indicator VI, here in the form of a light emitting diode, which displays information about the current active functional mode FM of the audio foot pedal AFP. In this embodiment, optional modes include an off/bypass of the audio foot pedal AFP, and an on mode where a signal processing algorithm is active. Further in this embodiment, variable parameters VP of the signal processing algorithm of a functional mode FM are changed by the control signal CS in accordance with the button's position along the travel range, which due to the spring arrangement SPA is experienced as the amount of applied force to the activation arrangement AA, which is also displayed. However, in another embodiment the display may comprise a series of light emitting diodes dedicated for specific changes performed by the user or a digital or analogue display, illustrating the changes.

The musical instrument MI is communicatively coupled to the audio foot pedal AFP through the audio input arrangement ARI. The musical instrument MI is to be understood in a broad sense and may be any hand-operated stringed instrument, acoustic, semi-acoustic or electric, such as, e.g., a guitar, a bass, an electric guitar, an electric bass, an ukulele, a banjo, a harp, a violin, etc. In order to establish the guitar audio representing signal by use of the guitar any suitable method may be used, e.g. by means of common pick-ups or instrument microphones.

A speaker SPE is communicatively coupled to the audio output ATO of the audio foot pedal. The speaker SPE may be understood in a broad sense and may be any audio amplification system e.g. personal amplifier system, music instrument amplifier, mixers etc. however, in another embodiment the audio output arrangement may be communicatively coupled to a further guitar effect pedal or the like.

The usage of the audio foot pedal AFP is illustrated by a foot FO which is used to operate the pedal. The operational movement can vary depending on the result to be achieved but can comprise operation like e.g. a click movement where the button is pressed down for a brief amount time, a click and hold movement, where the button is pressed down and the foot held this position for a while, or a click and press movement where the button is pressed down followed by an increase in pressure, or any combination hereof. These movements can yield a command that switches between functional modes or switches to a modulation mode, where changes in variable parameters are made based on the force applied etc.

FIG. 3*a* illustrates a graph displaying an embodiment of the control signal CS in relation to the travel range TR. It illustrates a travel range TR, comprising a switching range SR and a modulation range MR, and a control signal curve CSC. The control signal curve CSC in the graph illustrates the transmitted control signal value of an activation arrangement AA having a spring arrangement comprising a spring and an elastic ring, i.e. having two different spring forces along the travel range. The graph shows a linear relation correlation between the amount of pressure (x-axis) applied on the multipurpose button MC and the control signal CS when the spring force is defined by the spring. As the spring becomes fully compressed the graph breaks over to a less steep increase, which is where the spring force of the elastic ring is engaged.

The switching range SR describes a set of control signal values that gets transmitted when the user applies a pressure to the button resulting in a position along the travel range within the switching range. The values in the switching range are used to determine if the user wishes to switch between algorithm functions, i.e. functional modes FM, in the signal processing arrangement SPU. In one embodiment, a switch command is determined if the user has pressed the button such that the spring is fully compressed. However, in another embodiment, the switching can also be determined by a threshold TH value in that given range, as illustrated.

In this embodiment, the modulation range MR describes a part of the travel range TR having a spring force that is greater than in the switching range SR. This range of values can be used to activate a second signal processing algorithm function SF in the signal processing arrangement SPU. Further, the control signal CS in this range, can be used by the second algorithm function SF as variable parameter VP inputs. Doing so enables the user to change the effect of the second function SF, as the user changes the amount of force applied to the button, resulting in slightly changed position of the button due to the relatively high spring force, while within the modulation range.

FIG. 3*b* illustrates an operational principle of an activation arrangement relating to the graph of FIG. 3*a*.

The activation arrangement AA comprise a stationary part SP, a multipurpose control button MC, a spring arrangement consisting of a first spring arrangement FSA and a second spring arrangement SSA, an output control signal CS and a travel range TR comprising a switching range SR and a modulation range MR.

In this embodiment, the activation arrangement comprises two spring arrangements. However, in another embodiment this activation arrangement may comprise one or several spring arrangements, which enables to create a unique control signal curve CSC. Further, in this embodiment the two activation arrangements have different resistance forces as explained in the description relating to FIG. 3*a*. However, in another embodiment, the two spring arrangements may comprise the same spring type e.g. they could both be springs and at the same time have the same resistance force.

In the embodiment illustrated in FIG. 3*b*, the first spring arrangement FSA pushes the multipurpose control button MC to a non-activated state e.g., a resting position. The resting defines a position of the multipurpose control button MC where it is in a fully extended position providing the longest travel range and opposite of a compressed state where the button is compressed and positioned close to the opposite end of its travel range.

From this resting position, the button can be pressed towards the stationary part SP by applying a force to the button. At a point along the travel range the button will engage the second spring arrangement which results in an increase in resistance force from the button's frame of reference.

In this embodiment, the travel range TR is divided into two regions, a switching range SR and a modulation range MR, where they in combination may cover the entire travel range TR. However, in another embodiment they may comprise part of the travel range TR. Further, these ranges may be abutting, partially overlapping or non-overlapping, as long as a part of the modulation range MR is not covered by the switch range SR and as long as at least a part of the switching range SR is not covered by the modulation range MR.

In this embodiment, the modulation range MR is within the active region of the second spring arrangement SSA. However, in another embodiment the modulation range MR comprise the entire second spring arrangement. The association of the different ranges with different spring arrangements may enable the user to get an intuitive understanding of which mode the user is operating in by knowing how much force needs to be applied to activate the second function, i.e. adjusting a variable parameter of a selected functional mode. The modulation range describes a group of control signal values CS that can be used to input as variable parameters in the second function SF of the selected functional mode.

FIG. 4 illustrates a timing diagram of an embodiment of the invention. In this embodiment the relation between control signal CS, signal processing algorithms and timing is described. The diagram is divided into three sequences S1, S2 and S3. S1 describes an activation sequence where the push of the button switches between functional modes, from a functional mode FM comprising off/bypass, to a functional mode FM comprising a first signal processing algorithm FF and a second signal processing algorithm SF, where the first signal processing algorithm FF is activated. S2 describes a modulation sequence where an increase in pressure on the button activates the second signal processing algorithm SF, i.e. the variable parameter adjustment, of the active functional mode, and finally S3 describes a termination sequence where the system switches functional mode FM to an off/bypass mode by a push of the button.

In sequence S1, the first signal processing algorithm FF of a functional mode FM is activated by pressing the control button MC and thereby increasing the value of the control signal CS. The activation is further based on checking whether the audio foot pedal AFP is already active or not. If the audio foot pedal AFP is in an off/bypass state e.g. in a bypass functional mode FM, the foot pedal will switch be in an active functional mode FM. After the user removes the pressure on the pedal resulting the control signal CS to return to its non-activated state, the audio foot pedal will remain in the first signal processing algorithm FF, and therefore in an activate mode.

In sequence S2 a "press and increase" foot motion is performed. As the control signal CS activated, a timer is initiated and the control signal CS is monitored. If the control signal CS is active in the entire time threshold TT. The user can increase the pressure on the button MC which then switches signal processing algorithm in the active functional mode FM to the second signal processing algorithm SF. While in the second signal processing algorithm SF, a further variable pressure is applied to the button resulting in a varying control signal CS. This value of the varying control signal CS can then be used as parameter input to the second signal processing algorithm SF of the selected functional mode, where the variable control signal CS is inserted as a variable parameter VP of the second signal processing algorithm SF. When the user removes the pressure on the multifunctional button MC, the audio foot pedal AFP then switches back to the first signal processing algorithm FF.

In sequence S3 the audio foot pedal AFP switches functional mode FM to a turned off/bypass mode by performing a click motion on the multifunctional control button MC. If this click movement is performed within a time period shorter than a predetermined time threshold TT and the audio foot pedal is in its active first signal processing algorithm FF state, the functional mode is switched to off or to bypass.

FIG. 5 illustrates a flowchart of an embodiment of the invention.

In the initial phase, the button is pushed down and the duration of that push is checked to see if it is above or below a threshold value. In the case of the duration being less than a threshold value, the functional mode FM status of the audio foot pedal AFP is checked and toggled from either off/bypass in a first functional mode FM to first signal processing algorithm FF in a second functional mode FM.

In the case of the duration being greater than the threshold value, the status of the audio foot pedal AFP is checked. If the pedal is turned off or in bypass, the functional mode FM will be switched to a second functional mode FM comprising a first signal processing algorithm FF and a second signal processing algorithm SF, starting with the first signal processing algorithm being active. After this check the system initiates a looping sequence where the force applied to the button, as determined by the button's position along the travel range, corresponds to the control signal CS being in the modulation range MR. If that is true, the second signal processing algorithm SF will be activated and a further check is performed to see if the push of the button is released.

Once the button is released the system switches back to being in the first signal processing algorithm FF.

The time intervals presented in this embodiment of the flowchart are the same value. However, in another embodiment these time intervals can be set independent of each other.

The invention claimed is:

1. An audio foot pedal comprising: an activation arrangement that includes a control button and a stationary part, the control button being secured to the stationary part for relative movement along a travel range, the activation arrangement providing a control signal in response to movement of said control button, the audio foot pedal further comprising at least one signal processing arrangement arranged to execute at least two different functional modes, wherein at least one of said functional modes, in response to said control signal, variably controls a signal processing of audio signals communicated to said at least one signal processing arrangement thereby producing an audio output signal and transmits the audio output signal to an audio output, wherein said travel range comprises a modulation range and a switching range, wherein said control signal in response to said control button moving in said switching range controls switching between said at least two functional modes, and wherein the control signal in response to said control button moving in said modulation range forms variable input parameters to a signal processing algorithm related to said at least one of said functional modes when the control signal has invoked a switching to said at least one of said functional modes.

2. The audio foot pedal of claim 1, wherein said modulation range and said switching range are non-overlapping.

3. The audio foot pedal of claim 1, wherein said modulation range and said switching range are partially overlapping.

4. The audio foot pedal of claim 1, wherein the travel range comprising the switching range and the modulation range, with the modulation range closer to the stationary part.

5. The audio foot pedal of claim 1, wherein the control button has a resting position at an extended position at one end of the travel range defining an end of the switching range, and a depressed position at the other end of the travel range defining an end of the modulation range.

6. The audio foot pedal of claim 1, wherein the modulation range is shorter than the switching range.

7. The audio foot pedal of claim 1, wherein the modulation range is less than half of the full travel range, and the switching range is more than half of the full travel range.

8. The audio foot pedal of claim 1, wherein the modulation range is 3 millimeters or less.

9. The audio foot pedal of claim 1, wherein the audio foot pedal is arranged to operate in the modulation range and variably control said at least one of said functional modes without invoking a switching of functional mode in the process.

10. The audio foot pedal of claim 1, wherein said at least two functional modes comprise a by-pass mode.

11. The audio foot pedal of claim 1, wherein the switching to said at least one of said functional modes is controlled on the basis of said control signal and a predetermined time threshold related to said control signal.

12. The audio foot pedal of claim 11, wherein said controlling of switching between said at least two functional modes on the basis of said control signal and said predetermined time threshold is arranged to toggle said functional modes when a duration of said control signal is shorter than said predetermined time threshold.

13. The audio foot pedal of claim 11, wherein said controlling of switching between said at least two functional modes on the basis of said control signal and said predetermined time threshold is arranged to switch to said at least one functional mode variably controlling said signal processing and perform said step of forming variable input parameters to said signal processing algorithm of said at least one of said functional modes, when a duration of said control signal is longer than said predetermined time threshold.

14. The audio foot pedal of claim 1, comprising a visual indicator displaying an indication of a functional mode selected by said control button.

15. The audio foot pedal of claim 1, wherein said control button is movable along said travel range under influence of a spring force arrangement, wherein said spring force arrangement establishes a first spring force within a first travel range of said control button, and a second spring force in a second travel range of said control button.

16. The audio foot pedal of claim 15, wherein the first spring force is active when the control button is in said switching range and at least said second spring force is active when the control button is in said modulation range.

17. The audio foot pedal of claim 15, wherein said second spring force is greater than said first spring force.

18. A method for controlling a signal processing arrangement of an audio foot pedal, the method comprising the steps of:

establishing a control signal in response to movement along a travel range of a control button of an activation arrangement relative to a stationary part of said activation arrangement of the audio foot pedal, said travel range comprising a modulation range and a switching range, receiving an audio signal and providing it to the signal processing arrangement, selecting a functional mode of said signal processing arrangement among at least two selectable functional modes, the selecting being based on said control signal in response to said control button moving in said switching range, and processing said audio signal by said signal processing arrangement in accordance with said selected functional mode and under variable control by said control signal in response to said control button moving in said modulation range, thereby establishing an audio output signal.

19. The method of claim 18, wherein a foot operated click movement executed within a time threshold and with a force driving said control button at least into a switching range of said travel range before it is released, controls said selecting a functional mode of the signal processing arrangement among said at least two functional modes.

20. The method of claim 18, wherein a foot operated click-and-hold movement followed by an increase in force driving said control button at least into a modulation range of said travel range which inputs control signal to said signal processing arrangement which activates said second functional mode and controls variable parameters in said second functional mode based on the amount of force applied to said control button.

21. An audio foot pedal comprising: an activation arrangement that includes a control button and a stationary part, the control button being secured to the stationary part for relative movement along a travel range, the activation arrangement providing a control signal in response to movement of the control button, the audio foot pedal further comprising at least one signal processing arrangement arranged to execute at least two different functional modes, wherein at least one of the functional modes, in response to the control signal, variably controls a signal processing of audio signals communicated to the at least one signal processing arrangement thereby producing an audio output signal and transmits the audio output signal to an audio output, wherein the travel range comprises a modulation range and a switching range, wherein the control signal in response to the control button moving in the switching range controls switching between the at least two functional modes, wherein the control signal in response to the control button moving in the modulation range forms variable input parameters to a signal processing algorithm related to the at least one of the functional modes when the control signal has invoked a switching to the at least one of the functional modes;

wherein the switching to the at least one of the functional modes is controlled on the basis of the control signal and a predetermined time threshold related to the control signal; and wherein the controlling of switching between the at least two functional modes on the basis of the control signal and the predetermined time threshold is arranged to toggle the functional modes when a duration of the control signal is shorter than the predetermined time threshold.

22. An audio foot pedal, comprising: an activation arrangement that includes a control button and a stationary part, the control button being secured to the stationary part for relative movement along a travel range, the activation arrangement providing a control signal in response to movement of the control button, the audio foot pedal further comprising at least one signal processing arrangement arranged to execute at least two different functional modes, wherein at least one of the functional modes, in response to the control signal, variably controls a signal processing of audio signals communicated to the at least one signal processing arrangement thereby producing an audio output signal and transmits the audio output signal to an audio output, wherein the travel range comprises a modulation range and a switching range, wherein the control signal in response to the control button moving in the switching range controls switching between the at least two functional modes, wherein the control signal in response to the control button moving in the modulation range forms variable input parameters to a signal processing algorithm related to the at least one of the functional modes when the control signal has invoked a switching to the at least one of the functional modes;

wherein the switching to the at least one of the functional modes is controlled on the basis of the control signal and a predetermined time threshold related to the control signal; and wherein the controlling of switching between the at least two functional modes on the basis of the control signal and the predetermined time threshold is arranged to switch to the at least one functional mode variably controlling the signal processing and perform the step of forming variable input parameters to the signal processing algorithm of the at least one of the functional modes, when a duration of the control signal is longer than the predetermined time threshold.

23. A method for controlling a signal processing arrangement of an audio foot pedal, the method comprising the steps of:

of the audio foot pedal, receiving an audio signal and providing it to the signal processing arrangement, selecting a functional mode of the signal processing arrangement among at least two selectable functional modes, the selecting being based on the control signal, and processing the audio signal by the signal processing arrangement in accordance with the selected functional mode and under variable control by the control signal, thereby establishing an audio output signal; and wherein a foot operated click movement executed within a time threshold and with a force driving the control button at least into a switching range of the travel range before it is released, controls the selecting a functional mode of the signal processing arrangement among the at least two functional modes.

24. A method for controlling a signal processing arrangement of an audio foot pedal, the method comprising the steps of:

of the audio foot pedal, receiving an audio signal and providing it to the signal processing arrangement, selecting a functional mode of the signal processing arrangement among at least two selectable functional modes, the selecting being based on the control signal, and processing the audio signal by the signal processing arrangement in accordance with the selected functional mode and under variable control by the control signal, thereby establishing an audio output signal; and wherein a foot operated click-and-hold movement followed by an increase in force driving the control button at least into a modulation range of the travel range which inputs control signal to the signal processing arrangement which activates the second functional mode and controls variable parameters in the second functional mode based on the amount of force applied to the control button.

* * * * *